United States Patent [19]

Ishihara

[11] 4,141,235

[45] Feb. 27, 1979

[54] HYDRAULIC BENDING MACHINE

[76] Inventor: Masamitsu Ishihara, 628 Hirai, Kannami-cho, Tagata-gun, Shizuoka-ken, Japan

[21] Appl. No.: 834,002

[22] Filed: Sep. 16, 1977

[30] Foreign Application Priority Data

Sep. 18, 1976 [JP] Japan ..... 51-125657[U]
Nov. 19, 1976 [JP] Japan ..... 51-155265[U]

[51] Int. Cl.[2] ..... B21D 9/05

[52] U.S. Cl. ..... 72/213; 72/383; 72/389

[58] Field of Search ..... 72/213, 212, 215, 386–388, 72/401, 389, 383, 381, 217

[56] References Cited

U.S. PATENT DOCUMENTS

| | | | |
|---|---|---|---|
| 2,464,459 | 3/1949 | Newlon | 72/389 X |
| 2,497,622 | 2/1950 | Mueller | 72/213 |
| 2,938,564 | 5/1960 | Rhodes | 72/383 X |

FOREIGN PATENT DOCUMENTS

| | | | |
|---|---|---|---|
| 1147691 | 6/1957 | France | 72/212 |
| 658003 | 10/1951 | United Kingdom | 72/389 |
| 850248 | 10/1960 | United Kingdom | 72/212 |
| 421403 | 12/1974 | U.S.S.R. | 72/389 |

*Primary Examiner*—Milton S. Mehr
*Attorney, Agent, or Firm*—Flynn & Frishauf

[57] ABSTRACT

A hydraulic bending machine comprises a reciprocating connector fitted symmetrically with a pair of roller holders having inner and outer rollers rotatably attached to the end portions thereof, respectively. In these inner and outer rollers to abut against a workpiece, the outer rollers have a diameter larger than that of the inner rollers. A guide block is disposed forward in the extending direction of the connector. When the connector extends, the workpiece is held between the rollers of the respective roller holders and the guide block. When the connector further extends, then the roller holders rock around their rocking centers, and the workpiece, pushed by the inner and outer rollers, is bent around the guide block. Since the diameter of the outer rollers is larger than that of the inner rollers, the workpiece is bent further by the outer rollers than by the inner rollers. Thus, there may be maintained a desired bending angle even with the restoring force applied to the workpiece after bending.

9 Claims, 9 Drawing Figures

HYDRAULIC BENDING MACHINE

BACKGROUND OF THE INVENTION

This invention relates to a hydraulic bending machine to bend reinforcing bars, metallic rods and the like to a desired angle.

Heretofore, both bending of reinforcing bars in construction fields and bending of metallic rods in fields of machine work, for example, have been achieved by using large-sized bending apparatus or manually by applying the principle of the lever. When using a large-sized bending machine, however, it is impossible to carry it, so that workpieces to be bent must be carried to the place of installation and returned to the original placed after bending operation, prohibiting us from performing bending operation quickly at need. Meanwhile, in the case of manual bending operation, it is hard to perform accurate bending operation in consideration of the restoring force which may be produced after bending, while operators would feel substantially fatigued, prohibiting them from achieving efficient bending.

SUMMARY OF THE INVENTION

An object of this invention, devised in consideration of the above circumstances, is to provide a light and compact hydraulic bending machine enabling any operator to perform accurate and speedy bending operation.

In order to attain the above object, the hydraulic bending machine according to the invention comprises a pair of roller holders rockably fitted at their respective inner and outer end portions with rollers having their respective circumferential surfaces or peripheries capable of abutting against a workpiece to be bent. Further, according to an embodiment of the invention, outer rollers attached to the outer end portions of the roller holders have a diameter larger than that of inner rollers attached to the inner end portions. These roller holders are rockably and symmetrically attached to a connector, which is coupled to the piston of a hydraulically-operated piston cylinder means and can reciprocate. A guide means is disposed opposite to the connector means on the axis thereof. This guide means holds the workpiece between itself and the respective rollers of the roller holders when the connector means extends forward and guides the rollers in bending the workpiece according to the rocking motion of the roller holders.

The hydraulic bending machine of this invention should preferably be automatically returned to its initial position after completion of a bending cycle for another bending cycle subsequent thereto.

The above and further objects and novel features of the invention will more fully appear from the following detailed description when the same is read in connection with the accompanying drawings. It is to be expressly understood, however, that the drawings are for purpose of illustration only and are not intended as a definition of the limits of the invention.

DETAILED DESCRIPTION OF THE PREFERRED EMBODIMENTS

Figure 1:
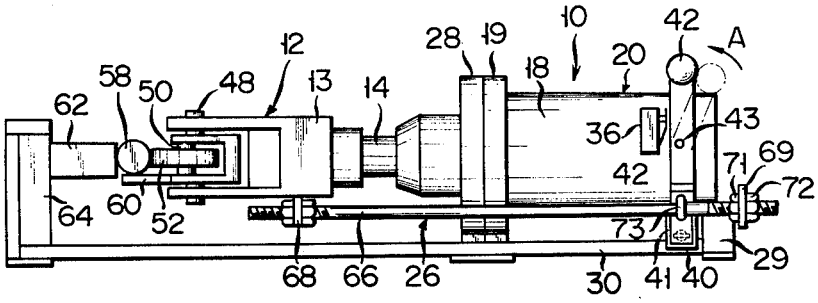
FIGS. 1 to 3 are front, plan and right side views of the hydraulic bending machine according to one embodiment of this invention showing the position thereof at the start of a bending cycle.

As shown in FIGS. 1 to 4, a hydraulic bending machine 10 according to one embodiment of this invention comprises a bending means 12 to abut against a workpiece to apply a bending force thereto and a hydraulic driving means 20 provided with a reciprocating piston 14 coupled with the bending means and a hydraulic cylinder 18 containing the piston and having outer and inner chambers 15 and 16 defined by a piston head. Further, the hydraulic bending machine 10 comprises an oil hydraulic circuit means 22 for controlling the oil flow into the cylinder 18 and an automatic return means 26 for switching the passage of the oil hydraulic circuit means when the piston has protruded by a prescribed stroke, thereby removing the pushing force against the piston 14 by pressure oil, and automatically returning the piston to the internal retracted position by a biasing means, such as a compression coil spring 24.

As may be clear from FIG. 1, the hydraulic cylinder 18 of the hydraulic driving means 20 is fixed and held on a base 30 by fixing a flange 19 to a support disc 28 by means of bolts (not shown) and setting the cylinder 18 on a support block 29. Meanwhile, as may be seen from FIG. 4, in the outer chamber 15 defined by the piston head is provided a biasing means, such as the compression coil spring 24, for producing biasing force to push the piston inward. The biasing means may be a tension spring disposed in the outer chamber 16 instead of being the compression spring, provided it can produce such biasing force that would move the piston inward. Also, such compression or tension spring may be disposed outside the chambers. Furthermore, this biasing means is not limited to a spring.

Figure 4:
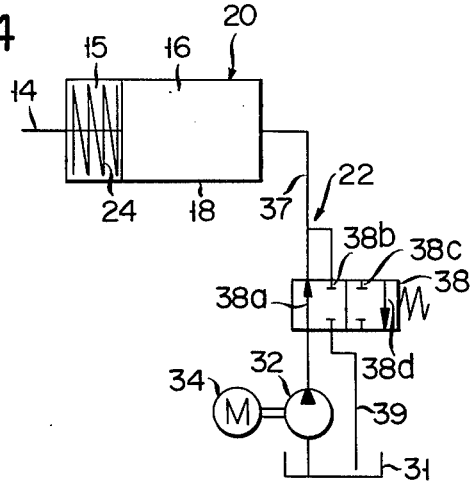
FIG. 4 is a circuit diagram of the built-in oil hydraulic circuit means.

The oil hydraulic circuit means 22 for controlling the flow into the inner chamber 16 of the cylinder 18, as shown in FIG. 4, includes an oil reservoir 31 to store oil, a motor 34 for operating a pump 32 so as to pressurize and feed the oil in the oil reservoir into the chamber 16, and a switch 36 (see FIG. 1) for controlling the power supply for the motor. In a main passage 37 extending between the pump 32 and the cylinder 18 is disposed a 4-port 2-position directional control valve 38, through which a drain passage 39 opening into the oil reservoir 31 is branched off from the main passage. In the directional control valve 38, an outermost port 38*a* opens the main passage to allow an oil flow from the pump to the inner chamber 16, while an innermost port 38*d* opens the drain passage to allow the oil to return to the oil reservoir from the inner chamber 16. On the other hand, both two central ports 38*b* and 38*c* operate so as to set a shutoff state. It is to be understood that the control valve 38 is not limited to one as shown in FIG. 4, and that any type of control valve may be used provided it has the desired functions. Here the switch 36 and the control valve 38 are attached to the cylinder 18 and a mounting plate 41 extending downward from the cylinder 18, respectively. Further, a change lever 42 for simultaneously changing the switcnh 36 and the control valve 38 is rockably attached to the cylinder 18 by means of a pivot pin 43.

Figure 2:
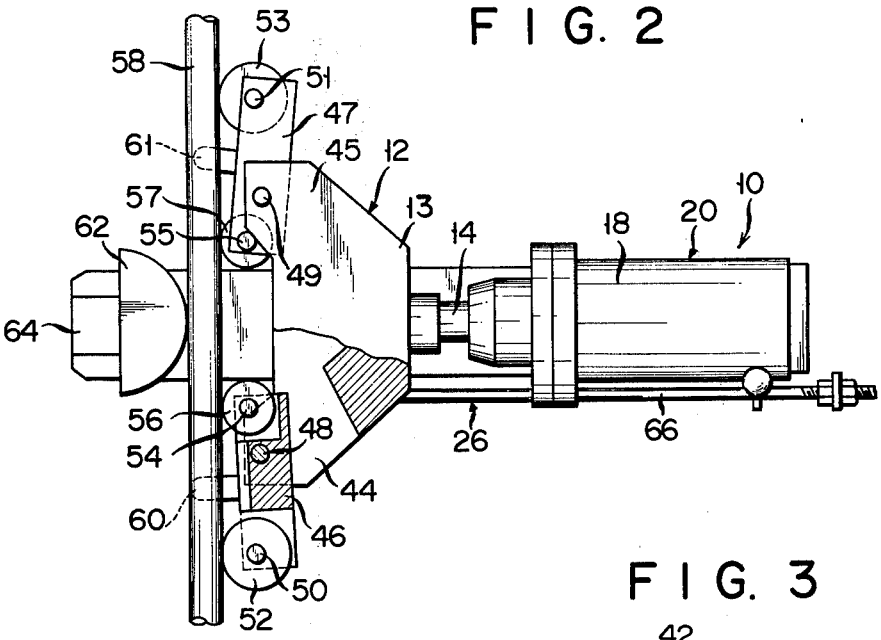

The bending means 12 to abut against the workpiece to apply a pushing force thereto, as shown clearly in FIG. 2, is provided with a connector 13 coupled to the piston 14. The connector 13 has bifurcately protruded ends 44 and 45, which have their respective hollow portions loosely fitted with roller holders 46 and 47 which are rockably attached to the connector 13 by means of pivot pins 48 and 49 respectively. A pair of roller holders 46 and 47 have their respective bifurcate ends, which are rockably fitted with large-diameter rollers 52 and 53 at outer portions thereof by means of pivot pins 50 and 51 as well as with small-diameter rollers 56 and 57 at inner portions thereof by means of pivot pins 54 and 55, respectively. These roller holders 46 and 47 of the same shape are symmetrically located on the connector 13. Meanwhile, support arms 60 and 61 for holding a workpiece, such as a reinforcing bar 58, extend laterally from the roller holders 46 and 47 respectively.

Further, to a guide block 64 fixed on the base 30 is attached a semicylindrical guide 62 opposite to the connector 13.

Figure 3:
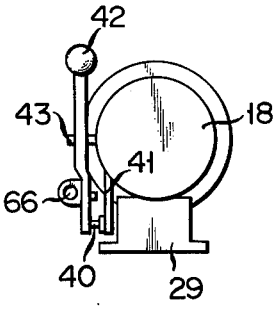

The automatic return means 26 for automatically returning the piston 14 inward, as shown clearly in FIGS. 1 and 3, is provided with a rod 66 with both ends threaded. One end of the rod 66 is fixed to a support plate 68 extending downward from the connector 13 by means of nuts, while the other end is fitted with a pair of nuts 71 and 72 facing each other with a washer 69 between. The rod 66 extends through an eyebolt 73 pivotally attached to one end of the change lever 42. The distance between the eyebolt 73 and the nut 71 may be determined correspondingly to the stroke of the piston 14.

The operation of the hydraulic bending machine 10 with such construction as described above will now be explained below. First, the change lever 42 is rocked round the pivot pin 43 in a direction A (counterclockwise) from a position indicated by the imaginary lines in FIG. 1, thereby turning the switch 36 on, and the control valve 38 is so shifted as to bring the port 38*a* in alignment with the main passage 37 (see FIG. 4). When the switch 36 is turned on, the motor 34 is started and the oil is sucked up from the oil reservoir 31 and pressurized by the pump 32. The pressure oil flows into the inner chamber 16 of the cylinder 18 from the main passage 37 through the port 38*a* of the control valve 38, thereby extending the piston 14.

Figure 5:
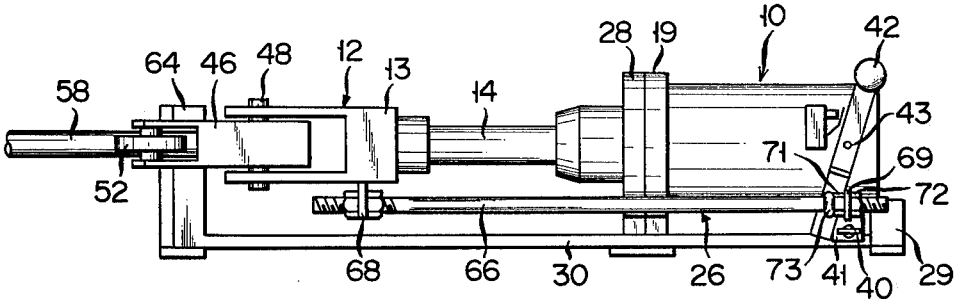
FIGS. 5 and 6 are front and plan views of the hydraulic bending machine of FIGS. 1 to 3 showing the position thereof at the end of a bending cycle.
Figure 6:
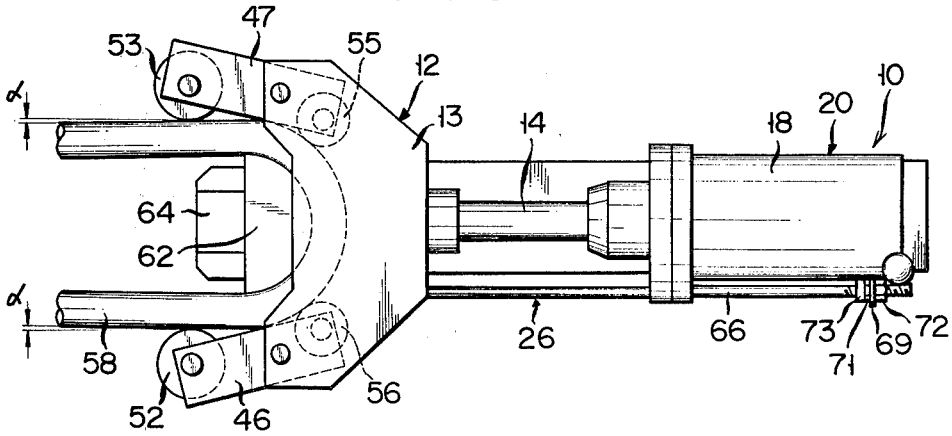

When the piston 14 is extended, the connector 13 moves forward in company with the piston 14 to hold the reinforcing bar 58 between the large- and small-diameter rollers 52, 53, 56 and 57 and the guide 62. When the piston 14 is further extended, as shown in FIGS. 5 and 6, the large-diameter rollers 52 and 53 revolve clockwise or counterclockwise on their own axes as well as round the pivot pins 48 and 49 respectively, pushing and bending the reinforcing bar 58. At this time, the small-diameter rollers 56 and 57 also revolve both on their axes and round the pivot pins 48 and 49, pressing on the reinforcing bar 58 so as to allow it to be bent close round the periphery of the guide 62 without escaping away therefrom. Since the diameter of the rollers 52 and 53 located in the outer positions is larger than that of the rollers 56 and 57 located in the inner positions, each end portion of the reinforcing bar 58 is inclined inward by a declination $\alpha$ as compared with the horizontal plane. The angle of declination $\alpha$ is determined in consideration of the factors, such as material and diameter thereof, regarding the restoring force of the workpiece. Thus, there may be obtained the reinforcing bar 58 with more accurate bending angle 180° when the end portion has spread outward through the declination $\alpha$ by its restoring force after bending. When the desired bending is performed with the piston 14 extended by a prescribed stroke, the nut 71 on the rod 66 coupled to the connector 13 hits against the eyebolt 73 to rock the change lever 42 clockwise round the pivot pin 43 (see FIG. 5). When the change lever 42 is rocked clockwise, the thrust applied by the change lever 42 is removed, so that the motor switch 36 is turned off and the push-type control valve 38 is shifted to bring the port 38*d* in alignment with the drain passage 39. As the switch 36 is turned off and the motor 34 is stopped, the supply of the pressure oil to the inner chamber 16 is intercepted, and the oil in the inner chamber 16 is forced out by the biasing force of the spring 24. The oil flown out of the inner chamber 16 is introduced into the drain passage 39 and returned to the oil reservoir 31 through the port 38*d*, and the piston 14 is turned to its retracted position. Preparation for the subsequent bending cycle is finished by removing the bent workpiece 58. Then, another workpiece 58 is placed on the support 60 and the change lever 42 is rocked counterclockwise, thus conducting continuous bending operation.

According to one embodiment of this invention, as described hereinbefore, the bending operation is performed by rotating the large-diameter and small-diameter rollers round the rocking points while applying the pushing force to the reinforcing bar from outer positions by the large-diameter rollers as well as from inner positions by the small-diameter rollers, so that the end portions of the reinforcing bar may be bent further as compared with the central bent portion.

Accordingly, there may be performed such bending operation that an accurate bending angle can be obtained at a point of time when the end portions of the reinforcing bar have been spread by the restoring force after bending. Further, a pair of roller holders fitted with the large-diameter and small-diameter rollers are so constructed as to reciprocate in company with the connector coupled to the piston-cylinder means, so that there may be obtained a compact and light hydraulic bending machine with a simple construction.

Moreover, according to the aforesaid embodiment of this invention, the bending machine is so constructed that the piston may be returned automatically by automatically rocking the change lever for shifting the motor switch and control valve of the oil hydraulic circuit means on completion of each bending cycle to shift the switch and control valve simultaneously. Therefore, the operator can carry out continuous bending operation easily and quickly without any fatigue by only setting each workpiece and then shifting the change lever so as to shift the switch and control valve to the prescribed position.

Figure 7:
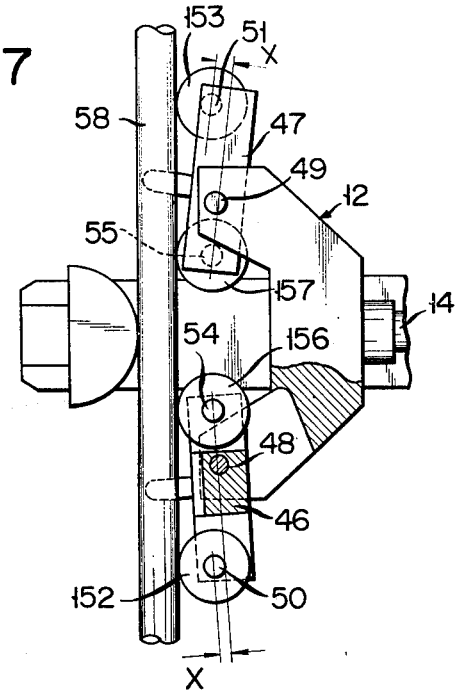
FIGS. 7 and 8 are plan views of the bending means fitted with the rollers of the same diameter according to an alternative embodiment of the invention showing the positions thereof at the start and end of a bending cycle, respectively.
Figure 8:
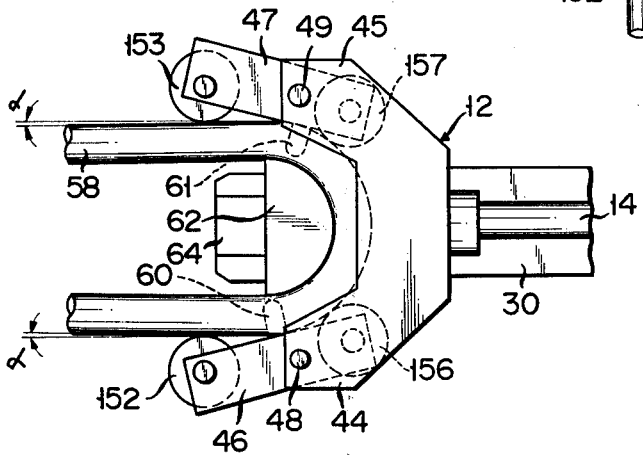

If the inner and outer rollers have the same diameter, then outer rollers 152 and 153 are located in offset positions nearer to the direction of the reinforcing bar 58 as compared with inner rollers 156 and 157, as shown in FIG. 7. Referring to FIG. 8, showing the bending machine with the inner and outer rollers of the same diameter in a position immediately after completion of a bending cycle, bending operation may be achieved in the same manner as in the case where the large-diameter outer rollers and the small-diameter inner rollers are employed.

Figure 9:
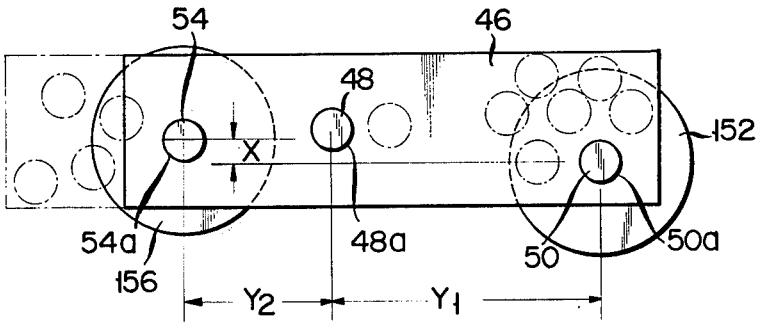
FIG. 9 is a plan view of the roller holder showing an alternative embodiment.

An offset X of each outer roller as compared with its corresponding inner roller has a substantial effect on the declination $\alpha$. Since the restoring force may vary substantially with the material, diameter and the like of the workpiece, the declination $\alpha$ should preferably be able to be variably set. As shown in FIG. 9, if a number of roller mounting holes 50*a* and 50*b*, loosely fitted with the pivot pins 50 and 54 respectively, are formed eccentrically in the roller holder 46, then the offset X may be easily varied, thereby coping with varied restoring forces. Otherwise, a number of pivot pin holes 48*a* to receive the pivot pin 48 for mounting the roller holder 46 on the connector 13 may be formed in the roller holder 46, thus allowing the declination $\alpha$ to be varied with changes of distances Y1 and Y2 between the pivot pin holes 48*a* and the roller mounting holes 50*a* and 54*a* by shifting the position of the pivot pin 48. Further alternatively, a number of mounting holes for mounting the pivot pin 48 on the connector 13 may be formed in the connector, thus varying the absolute setting position of the roller holder itself.

I claim:

1. In a hydraulic bending machine, comprising a bending means to abut against a workpiece to apply a bending force thereto; a piston-cylinder hydraulic driving means provided with a reciprocating piston coupled with the bending means and a hydraulic cylinder containing the piston and having two chambers defined by the head of the piston; and guide means to hold the workpiece between itself and the bending means;

the improvement wherein:

the hydraulic driving means includes biasing means for biasing the piston to a retracted position;

and wherein the bending machine further comprises:

an oil hydraulic circuit means including an oil reservoir, a pump, a motor for operating the pump and feeding pressure oil in the oil reservoir into one of the chambers of the cylinder of said piston-cylinder driving means to protrude the piston, a switch for the motor, and a directional control valve coupled to said pump and to said cylinder and having a first port to allow the pressure oil to pass from the pump to one chamber of said cylinder and a second port to allow the pressure oil, forced out of one chamber by the biasing means and returning to the oil reservoir, to pass;

a rockable change lever coupled to said motor and directional control valve for switching on the motor and shifting the directional control valve so as to let the oil flow through the first port when rocked in one direction as well as for switching off the motor and shifting the directional control valve so as to let the oil flow through the second port when rocked in the opposite direction; and automatic piston return means including a rod to protrude integrally with the piston according to the protrusion of the piston and a stopper arranged to abut against the change lever to rock the change lever in the opposite direction when the piston attached to the rod has protruded through a prescribed stroke.

2. A hydraulic bending machine according to claim 1, wherein the stopper of the automatic piston return means is variably attached to the rod so as to allow the stroke of the piston to be adjusted.

3. A hydraulic bending machine according to claim 2, wherein the rod has an external thread, and the stopper of the automatic piston return means comprises nuts engaged on the external thread of the rod.

4. A hydraulic bending machine according to claim 3, wherein the biasing means is positioned in either chamber of the cylinder.

5. A hydraulic bending machine according to claim 1, wherein the bending means includes a pair of roller holders rockably fitted at their respective inner and outer end portions with rollers having their respective peripheries adapted to abut against the workpiece, outer rollers attached to the outer end portions and adapted to apply a pushing force to the workpiece in consideration of the restoring force of the workpiece, and a reciprocating connector fitted rockably and symmetrically with the pair of roller holders by means of pivot pins inserted in pivot holes formed in the roller holders and coupled to the piston of the hydraulic driving means.

6. A hydraulic bending machine according to claim 5, wherein the outer rollers attached to the outer end portions of the roller holders and the inner rollers attached to the inner end portions have substantially the same diameter, and each of the outer rollers, when abutting against the workpiece, is attached to the roller holder at a position nearer to the workpiece as compared with its corresponding inner roller.

7. A hydraulic bending machine according to claim 6, wherein the stopper of the automatic piston return means is variably attached to the rod so as to allow the stroke of the piston to be adjusted, the rod has an external thread, and the stopper of the automatic piston return means is composed of nuts engaged on the external thread of the rod.

8. A hydraulic bending machine according to claim 5, wherein the outer rollers attached to the outer end portions of the roller holders have a diameter larger than that of inner rollers attached to the inner end portions of the roller holders.

9. A hydraulic bending machine according to claim 8, wherein the stopper of the automatic piston return means is variably attached to the rod so as to allow the stroke of the piston to be adjusted, the rod has an external thread, and the stopper of the automatic piston return means comprises nuts engaged on the external thread of the rod.

* * * * *